US006286159B1

(12) United States Patent
Yang

(10) Patent No.: US 6,286,159 B1
(45) Date of Patent: Sep. 11, 2001

(54) SOFA BED STRUCTURE

(75) Inventor: I-Chung Yang, Taipei (TW)

(73) Assignee: Giant Century Inc., Taipei (TW)

( * ) Notice: Subject to any disclaimer, the term of this patent is extended or adjusted under 35 U.S.C. 154(b) by 0 days.

(21) Appl. No.: 09/537,302

(22) Filed: Mar. 29, 2000

(51) Int. Cl.[7] ..... A47C 17/17
(52) U.S. Cl. ..... 5/38; 5/43
(58) Field of Search ..... 5/43, 47, 48, 37.1, 5/38

(56) References Cited

U.S. PATENT DOCUMENTS 5,327,591 * 7/1994 Fireman et al. ..... 5/47

FOREIGN PATENT DOCUMENTS

2525094 * 10/1983 (FR) ..... 5/37.1

785321 * 10/1957 (GB) ..... 5/38

* cited by examiner

*Primary Examiner*—Alexander Grosz
(74) *Attorney, Agent, or Firm*—Rosenberg, Klein & Lee

(57) ABSTRACT

An improved sofa bed structure if provided which comprises a base frame, a back support frame and a rear back support frame that are sequentially assembled using pin connections to form an integral bedstead. Each frame is equipped with a net frame to form a bed board structure. The whole bedstead is fastened by the interlocking of a base frame to a fixed base. The bedstead functions as a fully opened bed board structure or a folded sofa structure. When the whole structure is folded as a sofa, the fixed foot bars of the rear back support frame are received in saddles of the fixed base. The end portion of the rear back support frame and foot portions of the fixed base are fully in contact with one another to achieve a transversal interlock effect and to strengthen the structural stability of the whole sofa base.

3 Claims, 5 Drawing Sheets

SOFA BED STRUCTURE

BACKGROUND OF THE INVENTION

1) Field of the Invention

The invention, an improved sofa bed structure, is to provide a firm sofa bed structure, which is a bed board as fully opened and is a sofa bed as folded. The bedstead can be fully opened or folded without difficulty. Especially, all the frame pipes of the bedstead are interlocked. Each bedstead can be disassembled as single tubular pipes to reduce the packing volume of the whole structure. It is not only advantageous to product packing or shopping but also reduce the cost for clearing export customs.

2) Description of the Prior Art

The invention, sofa bed structure, of prior of art primarily includes a fixed mattress and back support cushion. A transversally movable or foldable bed board is equipped at the location of seat cushion for a sofa bed, thus one can pull out or unfold a bed board to form a flat bed depending on practical spatial situation. One can also push or fold a bed board to conceal it for the use of a single sofa bed. However, for both of the methods in concealing a bed board by moving a bed board to the bottom of a seat cushion or folding bed board to the top of seat cushion, the majority of a sofa bed is still a structure comprising of a fixed base seat cushion and back support cushion. When it is fully opened, a back support cushion is not extendable as part of a bed board and eventually becomes a head board of a bed and not convenient in usage. Besides, the outlook of the whole product is in a shape of fixed sofa bed. It is huge in volume and not suitable for packing or shipping. It results unnecessary cost for clearing export customs due to greatly increased volume.

SUMMARY OF THE INVENTION

The invention, an improved sofa bed structure, comprising of a base frame, a back support frame and a rear back frame is sequentially assembled through pin connection as a bedstead structure. Each frame is equipped with a net. The whole bedstead is fastened by the fixture of a base frame and a fixed base. Besides, there are fixed foot bars with the same height of those on fixed base at the bottom edge of a rear back frame, which is far away from fixed base. At the location of back support frame near the connection of rear back frame, there are foldable folding foot bars. When a sofa bed is folded, back support frame and rear back frame are closely joined on one side of base frame to form a sofa bed structure. When the whole bed board is fully opened, back support frame and rear back frame are supported respectively on the basis of folded foot bars and fixed foot bars to make the whole bedstead become an integral structure and to extend base frame, back support frame, and rear back frame to form an integral sofa bed structure. The main objective of the invention is to increase area of usage for a bed board without becoming any usage obstacles.

Another objective of the invention of improved sofa bed structure is to fasten base frame onto a fixed base. There is certain crossing distance for fixed foot bars at rear back frame between the connection location for a base frame and back support frame and the lateral side of a fixed base. There is also a saddle located on the crossing position of fixed foot bars of a fixed base. When the whole bedstead structure is integrated as a sofa bed, the fixed foot bars of a rear back frame are firmly sit on the saddle of a fixed base to make rear back frame stand beside a fixed base. Also, due to the full contact of end frame edge of rear back frame and foot bars of a fixed base, transversal interlock effect is achieved to make the whole sofa bed much more firm.

Another objective of the invention of an improved sofa bed structure, is that all frame pipe of bedstead are connected by tubular interlocking structure. Each frame can be disassembled as individual pipe structure to reduce the volume of whole structure at packing for advantageous product packing and shipping and cost reduction for clearing export customs.

The followings are brief description for optimal embodiments of the invention for committee's better understanding in the structural assembly and operations of the invention.

DETAILED DESCRIPTION OF THE PREFERRED EMBODIMENT

Figure 1:
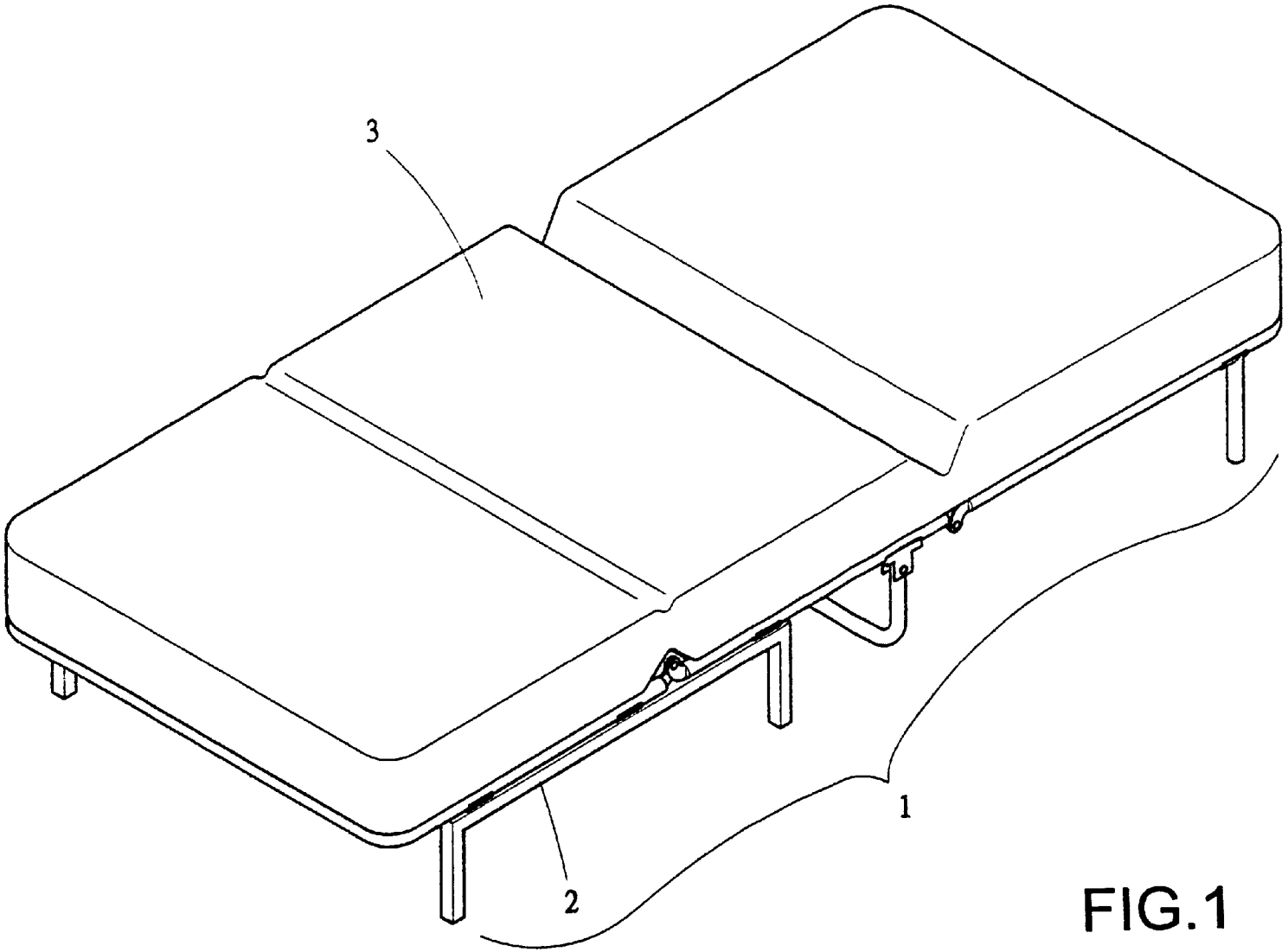
FIG. 1 is a structural drawing for an optional embodiment of the invention.
Figure 2:
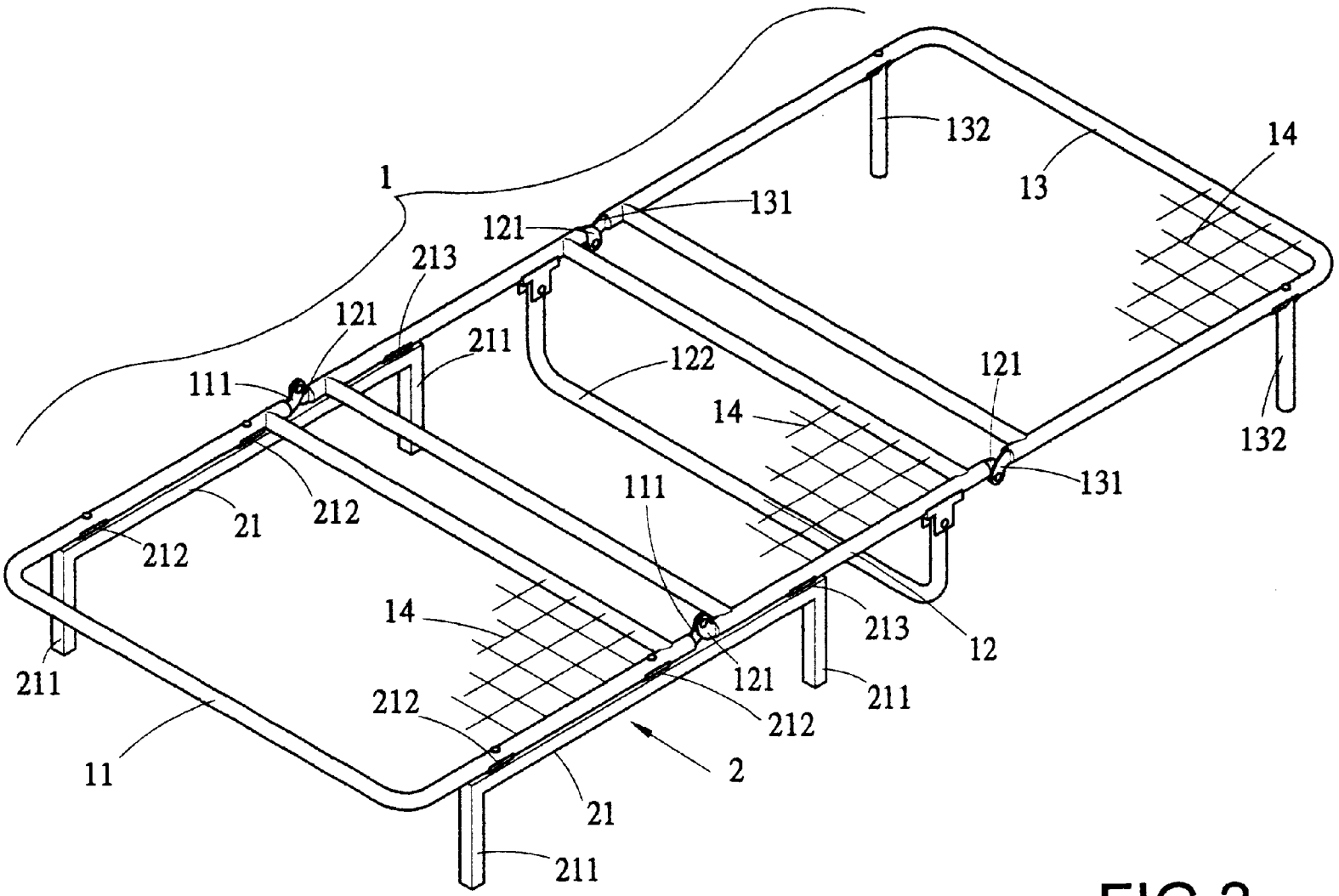
FIG. 2 is a structural drawing of the integral bedstead embodiment of the invention.
Figure 3:
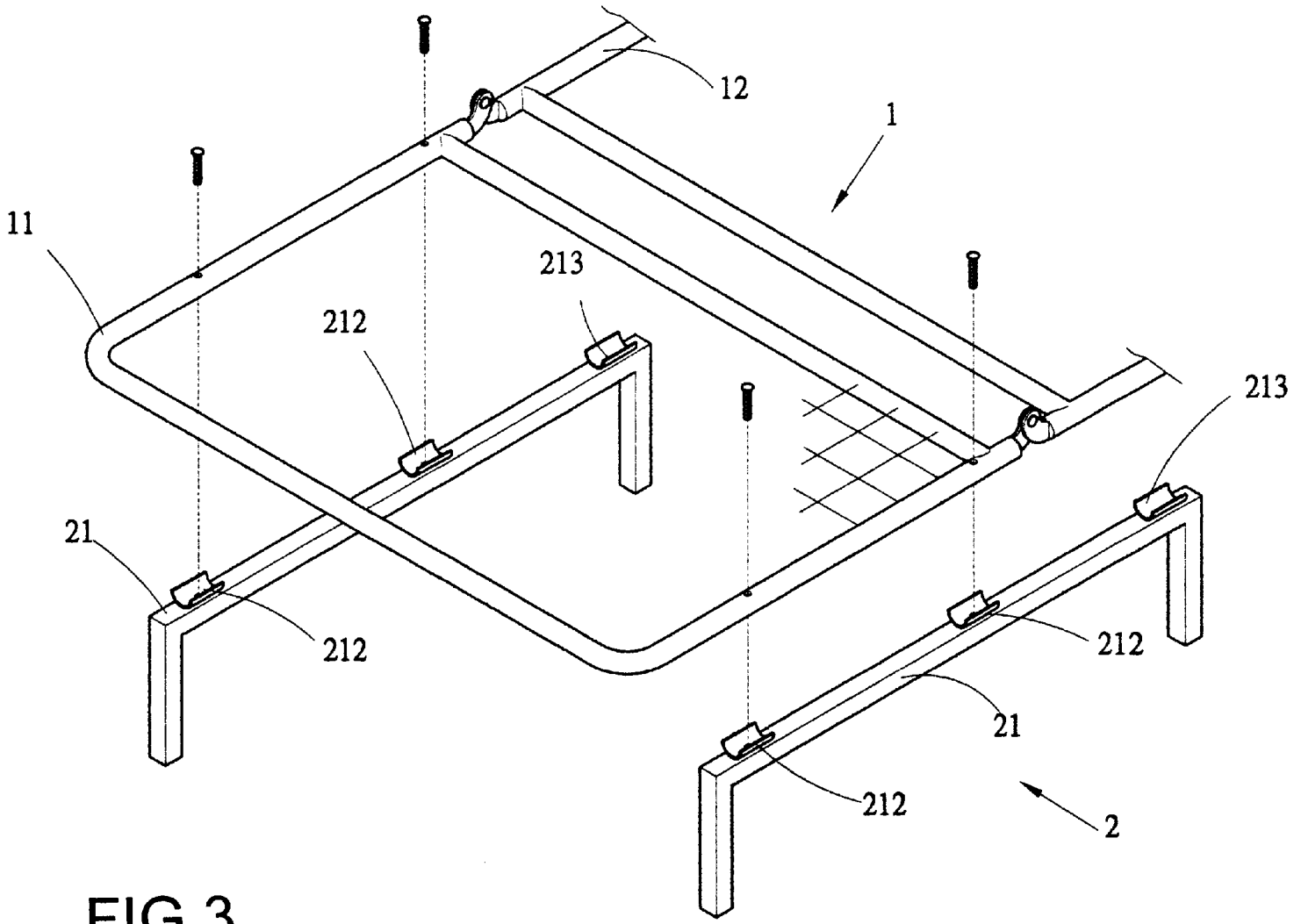
FIG. 3 is a structural exploded drawing of a bedstead and a fixed base of the invention.

As shown in FIG. 1, the basic structure of the invention, an improved sofa bed structure, includes bedstead 1 and mattress 3 on bedstead 1. Also, please refer FIG. 2 and FIG. 3, bedstead 1 comprising of base frame 11 and back support frame 13 are sequentially joined with pin connection. Each frame is equipped with a net frame 14 to form an integral bed board structure. The whole bedstead 1 is fastened by fixing a base frame 11 and a fixed base 2. Fixed base 2 is fastened below base frame 11 by two foot bars 21 in ∩ shape. Saddle 212 is placed at the position for locating seat frame 11 of foot bar 21 to make base frame 11 enable to be across sit on saddle 212 with firm screw fixture after accurate positioning. Besides, there are fixed foot bars 132, which are with the same height of foot bar 211 on fixed base 2 at the rear back frame 13 near bottom edge of extension. Also, a foldable folding foot bar 122 is equipped at back support frame 12 near pin connection 121 and 131 of rear back frame 113. There is a certain distance for across placing foot bars 132 on rear back frame between the joint locations 111 and 121 of base frame 11 and back support frame 12 and the lateral side of fixed base 2. As shown in FIG. 2, at the location for the fixture of fixed foot bars 132, saddle 213 is equipped on fixed base 2 to form a complete interlock structure by bedstead 1 and fixed base 2.

Figure 4:
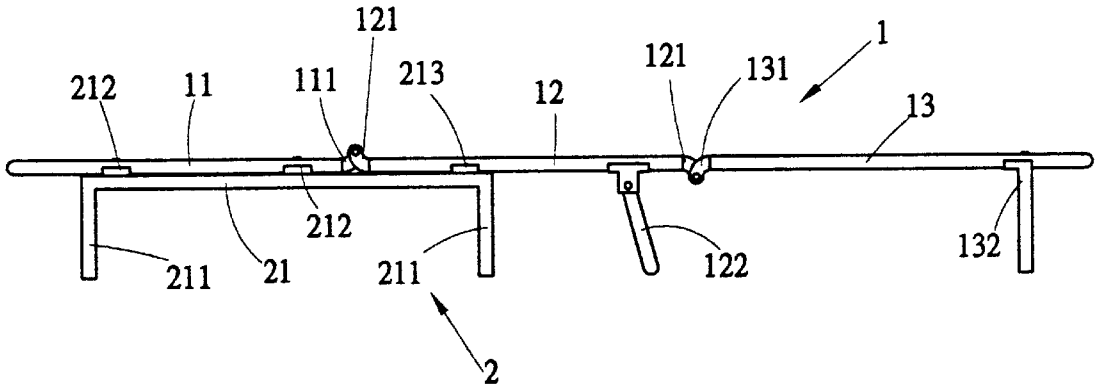
FIG. 4 is a profile drawing of bedstead embodiment in a fully opened state of the invention.
Figure 5:
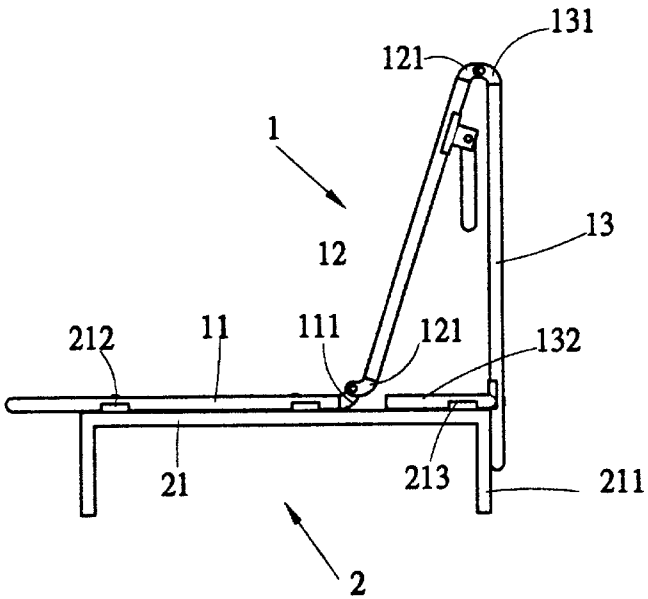
FIG. 5 is a profile drawing of bedstead embodiment in a folded state of the invention.
Figure 7A:
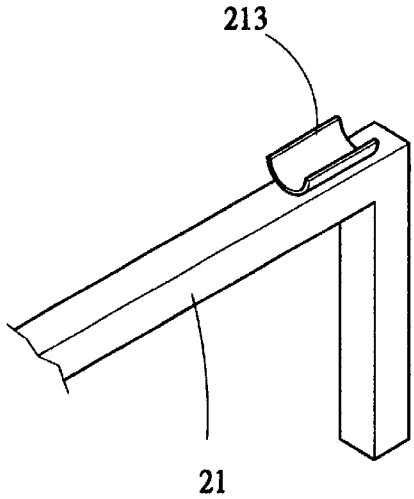
FIG. 7 (A) and (B) are structural drawings of saddle embodiment of the invention.
Figure 7B:
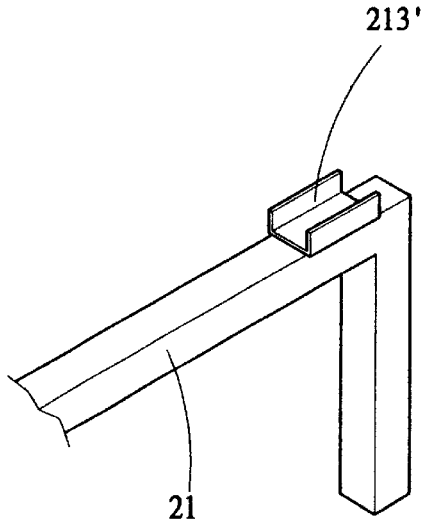

Referring to FIG. 4 and FIG. 5, the integral sofa bed structure of the invention is based on base frame 11 as the mattress majority of a sofa. With the folding effect of back support frame 12 and rear back frame 13, a user can fully open bedstead 1 as a bed board or fold it in straight for the use of back support pad of a sofa. First, as shown in FIG. 4, when the whole bed board is fully opened, the back support frame 12 and rear back frame 13 are relatively supported by folded foot bars 122 and fixed foot bars 132 and maintain same horizontal level of base frame 11 on fixed base 2 to make the whole bedstead 1 become an integral bed board structure. Then, as shown in FIG. 5, when bedstead 1 is folded, pin connection 121 and 131 of rear back frame 13 and back support frame 12 can be raised and folded foot bars 122 can be folded to make rear back frame 13 and back support frame 12 fully contact and to stand in straight on one end of base frame 11. It forms a back support structure of a sofa base and the bedstead becomes a sofa structure. Also, its fixed foot bars 132 on rear back frame 13 can be across sit on saddle 213 of fixed base 2 to make rear back frame stand in straight beside fixed base 2. In the mean time, the end frame edge on rear back frame 13 and foot bars 211 of fixed base 2 are fully contacted to achieve transversal interlock effect and to strengthen structural fixture of the whole sofa base. Regarding the type of saddle 213, it complies with the exterior structure of fixed foot stands 132. As shown in FIG. 7 (A) and (B), saddle 213 is in semi-circular shape or semi-square shape to comply with the sitting of bars on fixed foot bars.

Figure 6:
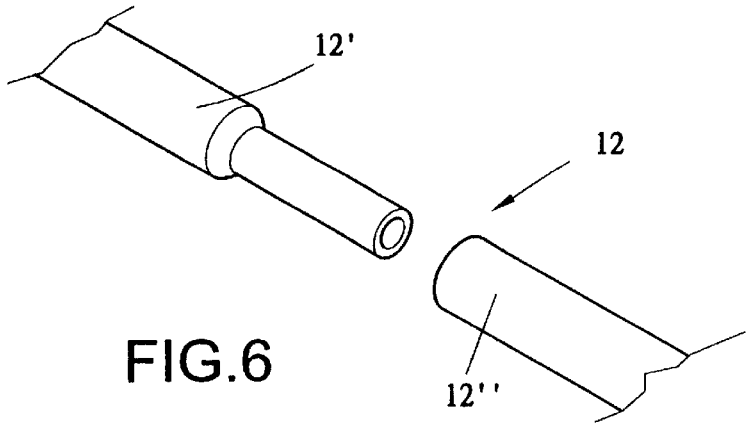
FIG. 6 is a connection structural drawing of frame bars of the invention.

Because, the fixed base in the invention is comprised by two foot bars 21 fastened below base frame 11. To further illustrate FIG. 6 with frame bars 12' and 12" on base frame 11, frame bars 12' and 12" are in tubular structure, which can be mutually joined. Each single frame of the bedstead can be disassembled as individual tubular structure, then the structure of the fixed base can be disassembled as single foot bars and fixed foot bars on rear back frame can also disassembled to completely disassemble the whole sofa bed structure as individual tubes, bars. The volume for integral structure for packing is greatly reduced for convenient product packing and shipping and cost reduction for clearing export customs.

For the invention, an improved sofa bed structure, when the whole bedstead is fully opened, the base frame, back support frame and rear back frame are extended as an integral bed board structure to increase usage area for a bed board. When, sofa bed structure is folded as a sofa base, the fixed foot bars on rear back frame can be firmly seated on the saddle of a fixed base. In the mean time, the end frame edge on rear back frame and foot stands of fixed base are fully contacted to achieve transversal interlock effect and to strengthen structural fixture of the whole sofa base. Also, each single frame can be disassembled as individual tubular structure to reduce the overall volume for integral structure at packing for convenience of product packing and shipping and cost reduction for clearing export customs. The invention provides an optional embodiment for sofa bed structure.

The above explanation is a substantial embodiment of the invention, which provides greater practical performance than products of prior art. Furthermore, the present invention meets all new patent application requirements and is lawfully submitted for review and the granting of the commensurate patent rights to thereby encourage the spirit of invention and its rightful protection under the patent law.

What is claimed is:

1. A sofa bed frame structure, comprising:

a base frame (11), a back support frame (12) joined to said base frame (11) by pin connections;

a rear back support frame (13) joined to said back support frame (12) by pin connections;

a plurality of net frames (14) respectively joined to said base frame (11), said back support frame (12), and said rear back support frame (13);

a fixed base (2) secured to said base frame (11), said fixed base (2) including a pair of foot bars (21) each having an inverted U-shape, each of said foot bars (21) having a plurality of first saddles (212) coupled thereto for accurate positioning and securement to said base frame (11) with screws;

a foldable folding foot mounted to said back support frame (12) adjacent to said pin connections joining said back support frame (12) to said rear back support frame (13); and, a pair of fixed foot bars (132) secured to said rear back support frame (13), each of said fixed foot bars (132) having a height dimension equal to a height dimension of said foot bars (21).

2. The sofa bed frame structure as recited in claim 1, wherein each of said base frame (11), back support frame (12), and rear back support frame (13) are formed by a plurality of tubular structural members (12', 12") mutually joined together.

3. The sofa bed frame structure as recited in claim 1, wherein each of said foot bars (21) has a second saddle (213) coupled thereto for receiving a respective one of said fixed foot bars (132) therein when said back support frame (12) and said rear back support frame (13) are displaced to a folded position.

* * * * *